US006470949B1

(12) United States Patent
Iglesias Ballester

(10) Patent No.: US 6,470,949 B1
(45) Date of Patent: Oct. 29, 2002

(54) CLOSING SYSTEM FOR REFRIGERATING CHAMBERS

(76) Inventor: Miguel Angel Iglesias Ballester, Avenida Madrid, 122 (Mirasol), E-0190 Sant Cugat del Valles (ES)

( * ) Notice: Subject to any disclaimer, the term of this patent is extended or adjusted under 35 U.S.C. 154(b) by 0 days.

(21) Appl. No.: 09/673,071

(22) PCT Filed: Feb. 8, 2000

(86) PCT No.: PCT/ES00/00038

§ 371 (c)(1),
(2), (4) Date: Dec. 6, 2000

(87) PCT Pub. No.: WO00/47937

PCT Pub. Date: Aug. 17, 2000

(30) Foreign Application Priority Data

Feb. 9, 1999 (ES) ..... 9900330

(51) Int. Cl.[7] ..... A47H 3/00

(52) U.S. Cl. ..... 160/98; 160/103; 49/61; 49/63; 49/68; 49/142

(58) Field of Search ..... 160/98, 103, 41, 160/271, 310; 454/195; 52/207, 202; 62/440, 275; 312/405, 291; 49/68, 61, 63, 142

(56) References Cited

U.S. PATENT DOCUMENTS

| | | | | |
|---|---|---|---|---|
| 3,292,685 | A | | 12/1966 | Clark |
| 3,809,144 | A | * | 5/1974 | Garufo |
| 4,232,725 | A | * | 11/1980 | Gidge |
| 4,357,978 | A | * | 11/1982 | Keller et al. |
| RE31,328 | E | * | 8/1983 | Anderson et al. |
| 4,398,585 | A | * | 8/1983 | Marlow |
| 4,776,379 | A | | 10/1988 | Kraeutler |
| 5,326,211 | A | * | 7/1994 | Critchley |
| 5,445,209 | A | | 8/1995 | Lichy |
| 5,450,890 | A | * | 9/1995 | Pinkalla et al. |
| 5,794,678 | A | * | 8/1998 | Beringer et al. |
| 5,862,851 | A | * | 1/1999 | Stoebich et al. |
| 6,152,208 | A | * | 11/2000 | Kalempa et al. |

FOREIGN PATENT DOCUMENTS

| | | | |
|---|---|---|---|
| DE | 3422790 | | 1/1986 |
| DE | 3603417 | | 2/1987 |
| DE | 3906629 | | 11/1989 |
| DE | 3901304 | * | 7/1990 |
| DE | 4002399 | | 8/1991 |
| DE | 4242430 | | 10/1997 |
| FR | 2063408 | | 7/1971 |
| FR | 2674566 | | 10/1992 |
| FR | 2709782 | | 3/1995 |
| FR | 2747182 | | 10/1997 |
| GB | 105807 | | 5/1917 |
| WO | 9112404 | | 8/1991 |

* cited by examiner

*Primary Examiner*—Blair M. Johnson
(74) *Attorney, Agent, or Firm*—Ostrolenk, Faber, Gerb & Soffen, LLP

(57) ABSTRACT

This system is comprised of an insulated access door (6), which makes for the closure of the cold room (4) in coming into contact with the door frame (1) fixed onto the entrance (2) of said cold room (4), and a quick opening door made up of a moveable sheet (8) and the corresponding means of activation (9, 10). These means of activation are to be fixed to the exterior of the cold room (4). There is also a longitudinal slit (7) fixed onto the door frame (1) so that the sheet (8) can pass, this sheet (8) being able to effect the closure either in front of or behind the insulated door (6). The system includes a stopper device (7) which can close the slit (7) in order to minimize the temperature loss through same, and some means (71 and 161) of heating the slit (7) and some guides (16) on which the sheet (8) moves to its open or closed position.

10 Claims, 3 Drawing Sheets

CLOSING SYSTEM FOR REFRIGERATING CHAMBERS

DESCRIPTION

1. Aim of the Invention

This invention refers to a closing system for refrigerated cold rooms; this being for the type that includes an insulated access door that makes the seal when coming into contact with the door frame which is installed at the entrance to the cold room; and a quick opening door designed to minimise the changes of temperature whilst the insulated door remains open. Certain construction characteristics are present which allow the quick opening door to be integrated into the insulated door frame and make the closure of the cold room together with it; however the means of activating it are to be found on the exterior.

2. Background to the Invention

The refrigerated cold rooms have at the openings of the entrance, a door frame around their edge onto which the insulated access door closes.

One of the problems to be solved in these types of refrigerated cold rooms is that when the insulated access door is opened temperature changes occur on the inside of the cold room. These temperature changes can give rise to different disadvantages, such as the deterioration of the products which are being preserved, temperature oscillations which can be serious for the goods that are being stored and the increase in the energy consumption by the refrigeration equipment.

Some of the most used solutions in order to solve this problem are based on the use of plastic curtains made up of a series of layers of plastic strips in the automation of the insulated door, which does not have a high opening and closing speed, and in the use of doors with a high opening speed, both allow access to the cold room and at the same time, reduce the exposure time of the cold room to the temperature of the outside due to the high opening-closing speed.

The curtain of strips are sited in the opening of the entrance to the cold room and form a barrier behind the insulated access door; these curtains when pushed by people, fork lift trucks or any other element allow entrance or egress to the cold room.

The main problems with these curtains are the ease which they fear on being trapped by the transport fork lift trucks and that on passing through they offer resistance by rubbing against the products which can cause said products to fall, especially when these are piled up, for example onto fork lift trucks.

The quick opening doors are made up of flexible or rigid sheet, which is moved by some method of action which produces the opening or closing of the access opening.

These quick opening doors can be installed irrespective of the way which the sheet moves either vertically or laterally and using differing systems of detection and automation.

The installation of these quick opening doors is carried out either on the inside of the cold room, behind the insulated access door or equally on the outside of the cold room. In the first case the detection and activating components and mechanism of the quick opening door will be on the inside of the cold room, making the final cost of the system considerably more expensive, especially in the case of low temperature cold rooms.

In the case of the quick opening door located on the outside of the cold room, in front of the insulated door, it is essential to erect some type of ante chamber which has the insulated door in its interior, likewise the closure system for same, and therefore its installation is made considerably more complicated.

DESCRIPTION OF THE INVENTION

Patent N° FR-A-2.747.182 refers to a system of closure (a lock) for the cold room in which the use of quick door is provided. This door is made up of an element of lamination with some cross members to reinforce it, as explained, located in front of or behind the insulated access door to the lock or the cold room, driven by a driving mechanism and having capacity to be rolled up on a drum. The said system and drum being installed on the outside of the closure and of the cold room to which is gives access.

In order to solve the problems mentioned, the closure system of the cold rooms has been thought up. It exploits the advantages of the quick opening automatic doors, it allows the installation of the activation to be carried out on the outside of the cold room. The closing strip is between the insulated access door and the cold room or vice versa and it makes use of the door frame of the insulated door for the guidance of the quick door.

In accordance with the invention, this closure system is of the type which can be understood as: a surrounding door frame on the entrance to the cold room, an insulated access door which acts on the exterior side of the door frame fashioning the closure of the cold room and a sheet which, activated at the right moment, brings about the opening or closing the access opening to the cold room, the laminate and its motorization forming the assembly of a quick opening door designed to minimise the temperature variation in the interior of the cold room whilst the insulated access door of same remains open.

The system of the invention is characterised in that the surrounding door frame of the entrance opening to the cold room has a front section and a back section which protrude from the cold room wall, the laminate sheet of the quick opening door sliding by one or several slits located in any point of the doorframe threshold.

The take up system for the laminate sheet is suitably installed by means of a support structure on the outside of the cold room, parallel to the frame side which is provided with the slit for the laminated sheet to pass.

The installation of the take up system of the laminate sheet, likewise has motorization on the outside of the cold room, preventing these elements from having to bear the attacks that are suffered on the inside of the cold room.

In order to minimise the temperature variation by means of the slit along which the sheet passes, the system has been planned to include a stopper device to facilitate its closing.

Said stopper device can be made up of some materials having similar characteristics to the sheet, by a device which is activated by the insulated access door or by the sheet itself, or equally by a device automatically activated by outside elements or by some flexible profiles installed in the slit itself and which permanently act on the sides of the sheet without preventing its movement.

The system has been planned to include some means of heating. There are intended to avoid the formation of ice both on the mentioned slit and equally on the sheet guides, since this could prevent the correct working of the quick access door.

DESCRIPTION OF THE DRAWINGS

In order to complement the description that is being made and with the aim of helping to give a greater understanding of the nature of the invention a set of drawings is attached to this description. The drawings also form an integral part of same, and are as an illustrative basis and are not limiting to that which is being represented.

PREFERRED EMBODIMENT OF THE INVENTION

Figure 2:
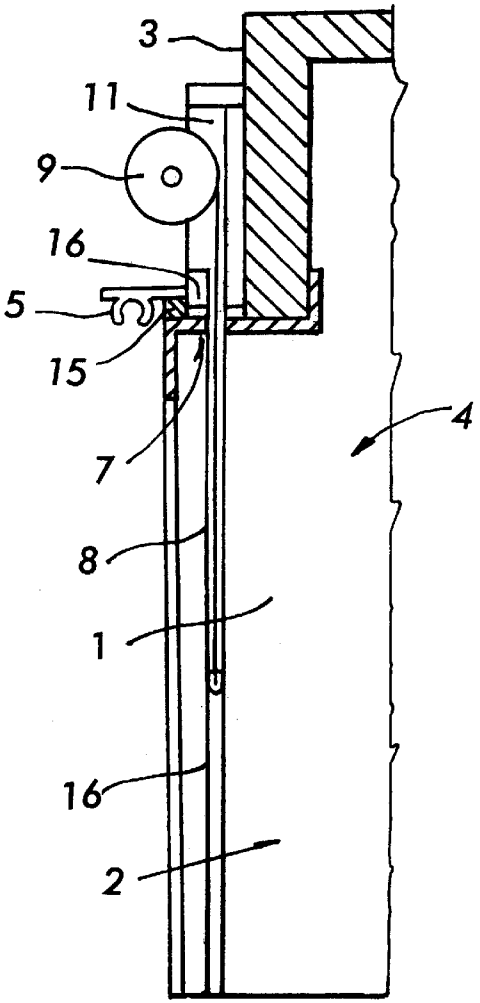
FIG. 2 shows a sectioned view in perspective of the closure system, by a vertical plan, which passes through the middle area of the entrance to the cold room.
Figure 1:
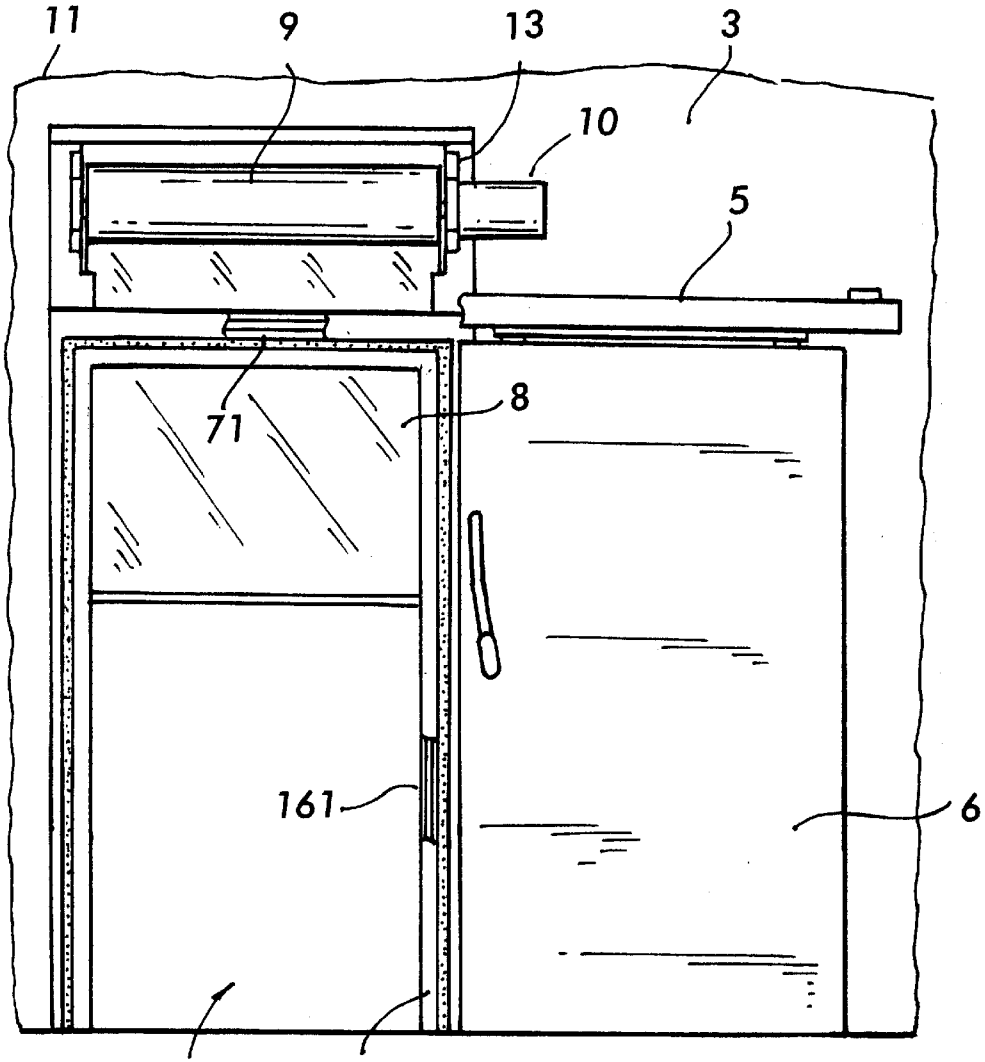
FIG. 1 shows a front view of a cold room provided with the closure system which is the object of the invention and in which the sliding track of the insulated access door has been partially shown. In this figure two sections have been carried out of the door frame in order to allow the heating means of the slits and the side tracks to be seen.

As can be seen in the attached drawings of the closure system which is the object of the invention, there is a door frame (1) installed on the entrance opening (2) defined on the wall (3) of a cold room, whose interior is marked with the reference (4).

A section of the front of the door frame (1) protrudes, towards the outside of the cold room (1), from the plan defined by the wall (3), to which a guide is found fixed (5) on which the insulated access door is moved (6), which governs the establishing of the closure of the cold room (4) when coming into contact with the door frame (1).

On the upper part of the door frame (1) there is, on the part which protrudes from the wall (3), a longitudinal slit (7) so that the flexible sheet can pass (8) which works in association with a revolving drum (9) onto which it can roll or unroll depending on the direction that the motor (10) which controls it is turning. The sheet (8), the drum (9) and the motor (10) fashion a quick opening door whose objective is to reduce to the minimum the change in temperature on the inside of the cold room (4) whilst the insulated access door (5) remains open.

When the sheet unrolls (8) it closes the entrance (2). This is placed further inside in respect of the front surface of the door frame and therefore behind the position that the door occupies (6) in the closed position.

The motor (10), which rolls the sheet (8) onto the drum (9), can be activated by different systems, which have not been represented because their description is not considered of interest.

As can be seen from the figures, and especially in FIG. 2, the drum (9) is placed outside of the cold room (1) and the mechanical support elements (11) are suitably separated in respect of the guides, so that the sheet (8) slides on the inside of the cold room (4) to avoid losses from conduction, producing a break of the thermal bridge between said elements.

Given that this slit (7) for the passage of the sheet (8) connects the inside of the cold room (4) with the exterior, a stopper device that closes said slit (7) is fixed onto the door frame (1) when the insulated access door (6) is closed, thus minimising the temperature variation. This slit (7) is capable of having some heating elements (71) on its inside which avoid the formation of ice caused by the temperature difference present from the interior to the exterior of the cold room.

Figure 3:
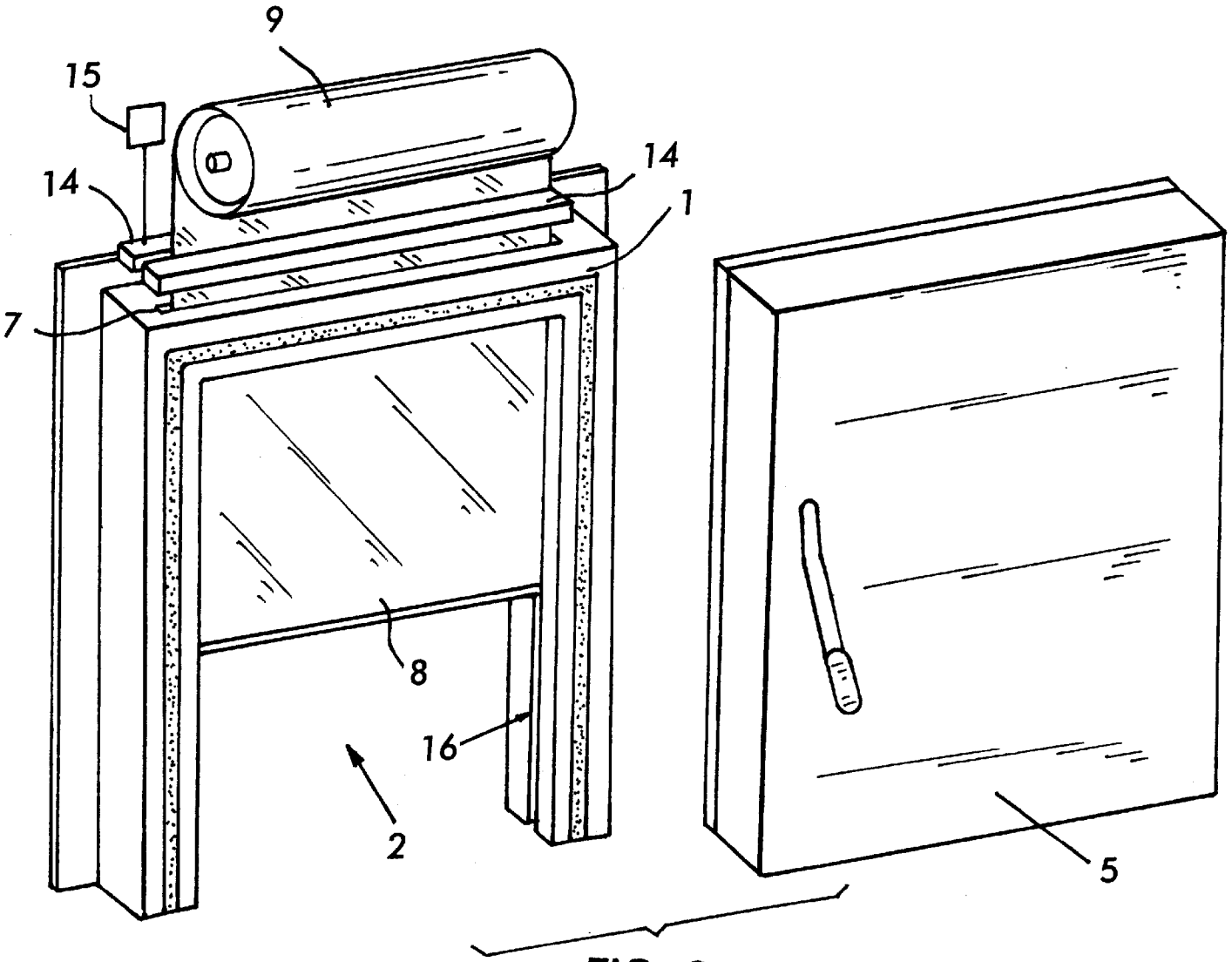
FIG. 3 shows a schematic view of the bars of the stopper device provided one on each side of the flexible sheet and slightly away from the vertical part of the door frame.

In the example carried out which is shown in FIGS. 2 and 3, and slit (7) stopper device is represented schematically by two parallel bars (14) which are located on the upper side of the door frame (1), one on each side of the slit (7) and, therefore, one on each side of the sheet (8). At least one of these bars (14) can be moved by the action of the activation mechanism (15) which causes the two bars to come together (14) and hence the closure of the slit (7).

Figure 4:
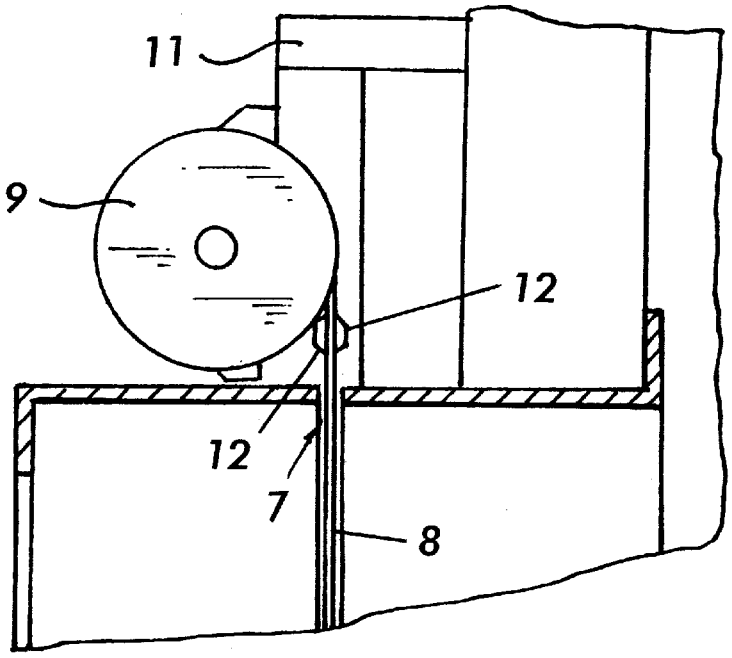
FIG. 4 shows a detail of a variant of the slit stopper device in order for the sheet to pass.
Figure 5:
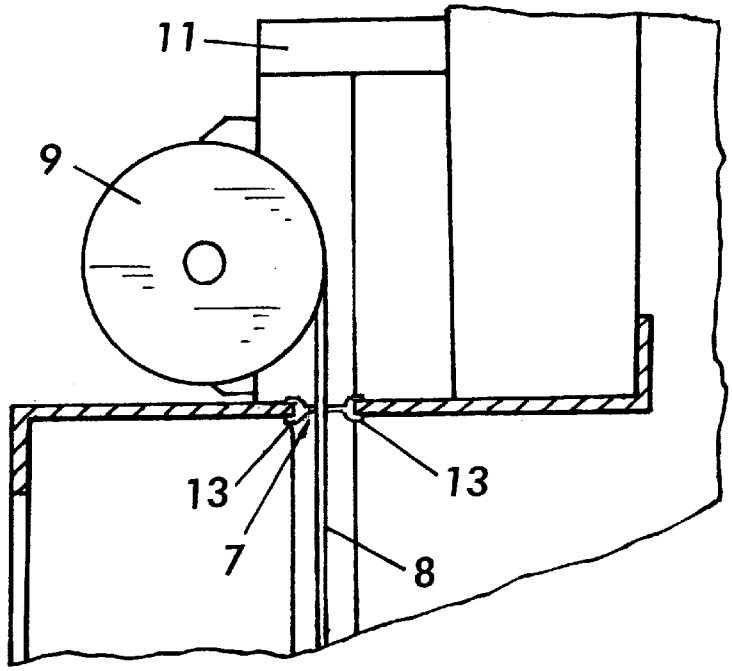
FIG. 5 shows a detail of another variant of the slit stopper device in order for the sheet to pass.

In the variant carried out which is shown in FIG. 4, the slit (7) stopper device is represented by two profiles (12) fixed onto the sides of the sheet (8). In the variant carried out which is shown in FIG. 5, the stopper devices is fashioned by some flexible profiles (13) fixed to the sides of the slit and that work in a permanent manner on the sheet (8) without hindering its movement.

On the vertical sides of the door frame (1) some guides are found (16) in order to guide the sheet (8) along its path to the open or closed position. These guides can have some method of heating (161) provided in order to avoid, if it is necessary, the formation of ice in same.

It is not considered necessary to make the description more complete as any expert in this subject can understand the scope of the invention and the advantages that derive from it.

The terminology used in the drafting of this description is always to be taken in the widest sense and is not limiting.

The materials, shape, size and arrangement of the elements are capable of being varied if and when it does not assume a modification of the essential nature of the invention, defined by the following claims.

What is claimed is:

1. A closure system for a refrigerated cold room wherein the cold room has a door frame around and defining an entrance opening of the room and a wall around the door frame;

an insulated access door supported at the frame and moveable between an open condition providing access to the entrance opening and a closed condition against the door frame for closing the entrance opening;

a flexible sheet which is adapted to be extended and when extended to cover the entrance opening of the cold room and is adapted to be rolled up to open the entrance opening; and a drive device located near the entrance opening and connected with the sheet for moving the sheet between being rolled up and being extended over the entrance opening for minimizing temperature loss while the insulated access door is in the open condition;

a protruding part protruding from the wall and near the door frame; an elongate slit in the door frame and at the protruding part and the slit being shaped, positioned and sized to permit the flexible sheet to pass through the slit as the sheet is moving between being extended and rolled up; the flexible sheet being guided in moving by passing through the slit to be one of in front of and behind the access door;

the frame having an internal side at least one groove being defined in the internal side of the frame for guiding the sheet for movement between being extended and rolled up;

a stopper positioned for closing the slit for minimizing temperature variations when the cold room is closed by the insulated access door.

2. The closure system of claim 1, wherein the door frame is shaped to protrude both to the front of and to the rear of the wall of the cold room; the flexible sheet being guided to slide along the at least one groove situated on the internal side of the door frame and the sheet being guided along the at least one groove by the slit through which the sheet passes.

3. The closure system of claim 1, wherein the protruding part of the door frame protrudes to the front, has opposite sides at opposite sides of the entrance opening and includes respective vertically disposed ones of the guide grooves on the opposite sides of the frame for guiding opposite edges of the sheet, the guide grooves being aligned with the slit in the frame.

4. The closure of claim 1, wherein the drive device for the flexible sheet comprises a roll up drum, a support structure for the drum on the door frame and separated from the at least one guide groove for the sheet, and a motor for driving the drum to rotate for rolling up and extending the sheet.

5. The closure system of claim 1, wherein the stopper comprises profiles integral with and moveable with the cover sheet.

6. The closure system of claim 1, wherein the stopper comprises flexible profiles fixed to the protruding part of the wall at sides of the slit and the profiles act on the sheet as it moves, without preventing movement of the sheet.

7. The closure system of claim 1, wherein the stopper comprises two parallel bars disposed to define the slit between them, a mechanical actuator for moving at least one of the bars for separating or moving the bars together for determining the opening or closing of the slit.

8. The closure system of claim 1, wherein the at least one groove includes a heater for preventing formation of ice on the groove.

9. The closure system of claim 1, further comprising a heater associated with the slit for preventing formation of ice on the slit.

10. The closure system of claim 1, wherein the drive device for the sheet is on the wall and external to the room and the protruding part protrudes forwardly from the wall and the slit is inward of the access door.

* * * * *